US012246229B2

(12) United States Patent
King et al.

(10) Patent No.: US 12,246,229 B2
(45) Date of Patent: Mar. 11, 2025

(54) COLLAPSIBLE GOLF BAGS, GOLF BAG KITS, AND RELATED METHODS

(71) Applicant: Stitch Golf Holdings, Inc., Apex, NC (US)

(72) Inventors: Bradley King, Cary, NC (US); Tanner Foster, Raleigh, NC (US); Grant Zechman, Raleigh, NC (US); Charles Burgwyn, Cary, NC (US)

(73) Assignee: Stitch Golf Holdings, Inc., Apex, NC (US)

( * ) Notice: Subject to any disclaimer, the term of this patent is extended or adjusted under 35 U.S.C. 154(b) by 124 days.

(21) Appl. No.: 17/868,443

(22) Filed: Jul. 19, 2022

(65) Prior Publication Data

US 2024/0024744 A1 Jan. 25, 2024

(51) Int. Cl.
*A63B 55/00* (2015.01)

(52) U.S. Cl.
CPC ..... *A63B 55/408* (2015.10); *A63B 2210/50* (2013.01)

(58) Field of Classification Search
CPC ..... A63B 55/408; A63B 2210/50; A63B 2210/52; A63B 55/00; A63B 55/60
USPC ..... 135/127
See application file for complete search history.

(56) References Cited

U.S. PATENT DOCUMENTS

D57,526 S 4/1921 Hunt
1,461,459 A 7/1923 Schank
1,739,702 A 12/1929 Wing
1,810,903 A 6/1931 Campbell
1,926,184 A 9/1933 Schwer
2,214,579 A 9/1940 Delin
2,358,057 A 9/1944 Herbert
2,435,479 A * 2/1948 Thommen ..... A63B 55/00 220/9.2

(Continued)

FOREIGN PATENT DOCUMENTS

CN 308051731 5/2023
GB 6062006 5/2019

(Continued)

OTHER PUBLICATIONS

PGM. Golf Stand Bag for Men & Women, Easy to Carry & Durable Pitch Golf Bags sunday golf bag Ideal for Golf Course & Travel, Lightweight and waterproof Black. Apr. 28, 2021. Amazon. <https://www.amazon.com/Durable-Sunday-Course-Lightweight-Waterproof/dp/B09YC7M18S?th=1> (Year: 2021).

(Continued)

*Primary Examiner* — Don M Anderson
*Assistant Examiner* — Justin Caudill
(74) *Attorney, Agent, or Firm* — Michael Best & Friedrich LLP

(57) ABSTRACT

Collapsible golf bags, golf bag kits, and related methods are provided herein. A collapsible golf bag can include a collapsible chassis having a top portion and a base with sidewalls therebetween. Additionally, the collapsible golf bag can include a foldable stiffening rod configured to engage a portion of the top portion of the chassis and the base of the chassis to separate the top portion and the base and extend the side walls to hold at least a portion of the sidewall taut. The golf bag kits can include a carrying container having an accessible interior, the collapsible chassis, and the foldable stiffening rod.

12 Claims, 9 Drawing Sheets

(56) References Cited

U.S. PATENT DOCUMENTS

| | | | | |
|---|---|---|---|---|
| 2,661,175 | A | 12/1953 | Holder | |
| 3,799,227 | A | 3/1974 | Cantwell | |
| 4,378,039 | A * | 3/1983 | Suk | A63B 55/00 206/315.8 |
| 5,041,815 | A | 8/1991 | Newton | |
| 5,314,150 | A | 5/1994 | Seop | |
| D352,394 | S | 11/1994 | Deioma et al. | |
| D358,934 | S | 6/1995 | Kelley | |
| D365,205 | S | 12/1995 | Holland, III | |
| 5,482,160 | A * | 1/1996 | Perrin | A63B 55/40 135/125 |
| 5,528,813 | A * | 6/1996 | Biafore, Jr. | A63B 55/00 206/315.8 |
| 5,590,773 | A | 1/1997 | Robinett | |
| 5,638,954 | A * | 6/1997 | Hsien | A63B 55/00 206/315.3 |
| D386,303 | S | 11/1997 | Wang | |
| 5,941,383 | A * | 8/1999 | Cheng | A63B 55/00 206/315.3 |
| D414,035 | S | 9/1999 | Stokes | |
| D436,440 | S | 1/2001 | Stokes | |
| 6,510,944 | B2 * | 1/2003 | Chang | A63B 55/00 206/315.6 |
| D472,375 | S | 4/2003 | Stokes | |
| D479,649 | S | 9/2003 | Chuan | |
| D494,363 | S | 8/2004 | Chuan | |
| D500,921 | S | 1/2005 | Chuan | |
| D704,439 | S | 5/2014 | Mangano | |
| 9,314,679 | B2 * | 4/2016 | Engel | A63B 55/40 |
| 2003/0089390 | A1 * | 5/2003 | Seo | E04H 15/60 135/120.4 |
| 2004/0035729 | A1 * | 2/2004 | Chang | A63B 55/40 206/315.6 |
| 2004/0226839 | A1 * | 11/2004 | Su | A63B 55/60 206/315.8 |
| 2006/0118441 | A1 * | 6/2006 | Cheng | A63B 55/40 206/315.7 |
| 2011/0162985 | A1 * | 7/2011 | Shiao | A63B 55/00 206/315.8 |
| 2018/0036608 | A1 * | 2/2018 | Martell | A63B 55/57 |
| 2024/0024744 | A1 | 1/2024 | King et al. | |

FOREIGN PATENT DOCUMENTS

| | | |
|---|---|---|
| SG | 2002944I-0001 | 2/2008 |
| SG | 20011214D-0001 | 3/2012 |

OTHER PUBLICATIONS

Stitch Golf. Stitch SL Sunday Golf Bag. Sep. 12, 2022. Golf Digest. https://www.golfdigest.com/products/ stitch-sl-sunday-golf-bag> (Year: 2022).

Amazon—Tourbon Vintage Golf Club Carry Bags. Travel Case—Canvas and Leather. Published Mar. 18, 2016. https://www.amazon.com/TOURBON-Course-Training-Practice-Travel/dp/B075WSMBBF/ref=asc_df_B075WSMBBF/?tag=&linkCode=dfO&hvadid=31%E2% 80%A6&th=1 (Year: 2016).

Sitch Golf—Stitch SL Sunday Golf Bag. Published Sep. 14, 2023. https://stitchgolf.com/products/stitch-sl-sunday-golf-bag ( Year: 2023).

The Hackers Paradise—Stitch SL Sunday Golf Bag. Published Aug. 22, 2022. https://www.thehackersparadise.com/stitch-sl-sunday-golf-bag/ (Year: 2022).

The Golf Auction—Vintage Par Bag Stovepipe Leather & Canvas Golf Bag—Atlantic Products Corp. Published Nov. 21, 2016. https://www.thegolfauction.com/vintage_par_bag_stovepipe_leather_canvas_golf_ba-lot21195.aspx (Year: 2016).

United States Patent Office Action for U.S. Appl. No. 29/846,779 dated Mar. 27, 2024 (2 pages).

* cited by examiner

COLLAPSIBLE GOLF BAGS, GOLF BAG KITS, AND RELATED METHODS

TECHNICAL FIELD

The presently disclosed subject matter relates to golf bags that can be collapsed to a compact size for easy packing and/or shipping. In particular, the present subject matter relates to collapsible, lightweight golf bags that can be used as a carry golf bag that can be broken down to a compact size and can be expandable to a useable golf bag.

BACKGROUND

Golfing has been a popular sport for over a century. Traditionally, golfing requires a golf bag to carry a set of clubs. Golf bags are standard equipment in the game of golf for holding and transporting golf clubs. In general terms, a golf bag conventionally includes a tubular construction with a closed bottom, an open top, and a carrying strap attached between the closed bottom and the open top. The open top receives the golf clubs while the closed bottom and an outer shell of the golf bag defines an interior void to contain the golf clubs. The outer shell may be formed from materials and may be reinforced by a frame formed by one or more support members, such as rails or poles, thereby holding the bag in an open and taut state for holding the golf clubs. Well-designed and well-conceptualized bags are made to do a lot more than that, however. Such golf bags can make playing less stressful, while at the same time helping to add a splash of style to your game.

The size and weight of golf bags can vary depending on how these bags are used. For example, golfers who prefer to exclusively prefer to ride in golf carts during a golf outing may prefer the convenience of cart bags designed to be used on golf carts and provide a variety of compartments for the golfer, while golfers who prefer to walk the golf course and carry their own golf bag may prefer a carry bag, which is a lighter weight golf bag that provides less storage options but can be much easier to carry over the length of a golf course.

Stand bags and carry bags are golf bags designed to supports the rigors of walking a golf course. Stand golf bags are golf bags commonly used by many golfers today that are much lighter than a cart bag to allow them to easily be carried by a golfer but also stand up under a tripoint system when placed down before a shot by the golfer. Such stand bags are significantly lighter (5 pounds or less) than a cart bag with less storage capacity and feature two retractable legs to allow the bag to stand upright, preventing the bag and the clubs from being laid on the ground like other carry bags and keeping the clubs and bag from getting unnecessarily dirty. Stand bags may weigh a little more than other carry bags, but the clever leg mechanism allows easy access to any club during the playing of a round of golf while allowing the bag to stay upright on a variety of golf course terrains.

Due to their light weight, carry bags allow golfers to freely walk over the golf course without avoiding certain areas. Since carry bags need to be lightweight, these bags tend to be constructed of lightweight material with less space for the golfer's clubs. Carry bags also tend to have significantly less storage space. Carry bags may provide some storage for items such as balls, tees, a towel and possibly a range finder and a drink bottle. Carry bags serve their purpose as a cheap bag alternative that can carrying the golf clubs to be used on a course without much more added weight.

Due to their relatively low cost, carry bags are sometime used as promotion items for conventions and corporate outings. The size, and particularly, the length of such carry bags, make them more costly to ship and can raise the price per unit of the golf bag. This increased cost causes these bags to sometimes to be pushed out of the desired price point for such items.

Accordingly, a need remains for reducing the size of carry bags to make them more conducive for shipping and to provide a golfer with a way to conveniently store an extra carry golf bag when not in use. Disclosed herein is a collapsible golf bags that can address these needs.

SUMMARY

The presently disclosed subject matter relates to golf bags that can be collapsed to a compact size for easy packing and/or shipping. In particular, the present subject matter relates to collapsible, lightweight golf bags that can be used as a carry golf bag that can be broken down to a compact size and can be expandable to a useable golf bag. Additionally, the present subject matter also relates to compact kits that include components that can be easily assembled to form a golf bag and easily disassembled for storage or shipping. Methods related to the manufacture and use of the collapsible golf bags as disclosed herein are also provided.

While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1:
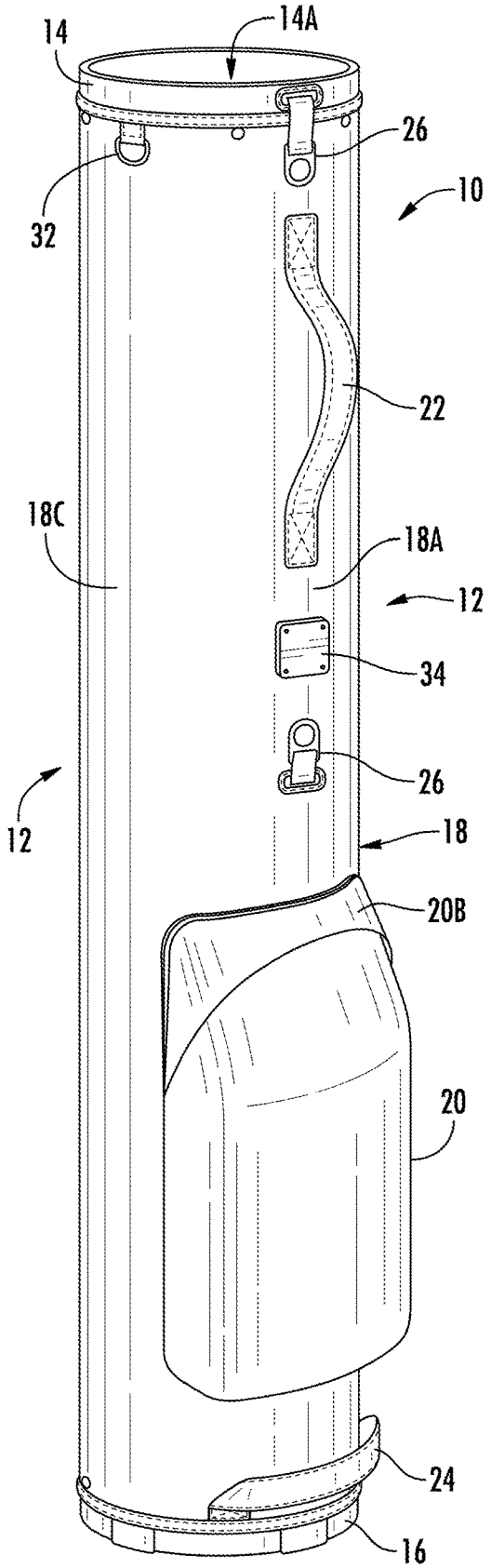
FIG. 1 illustrates a front left side perspective view of an embodiment of a collapsible golf bag that can be easily assembled and disassembled according to the present subject matter.

Repeat use of reference characters in the present specification and drawings is intended to represent the seam or analogous features or elements of the present subject matter.

DETAILED DESCRIPTION

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Although the terms first, second, right, left, front, back, top, bottom, etc., may be used herein to describe various features, elements, components, regions, layers and/or sections, these features, elements, components, regions, layers and/or sections should not be limited by these terms. These terms are only used to distinguish one feature, element, component, region, layer, or section from another feature, element, component, region, layer, or section. Thus, a first feature, element, component, region, layer, or section discussed below could be termed a second feature, element, component, region, layer, or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments of the subject matter of the disclosure are described herein with reference to schematic illustrations of embodiments that may be idealized. The drawings are not made necessarily to scale. Thus, not all embodiments within the scope of the drawings and these descriptions are made according to the apparent scale of the drawings with regard to relative dimensions in the drawings. As such, variations from the shapes and/or positions of features, elements, or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted, or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

Any dimensions expressed or implied in the drawings and these descriptions are provided for exemplary purposes. Thus, not all embodiments within the scope of the drawings and these descriptions are made according to such exemplary dimensions. It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

The present disclosure provides for golf bags that can be collapsed to a compact size for easy packing and/or shipping. In particular, the present subject matter relates to collapsible, lightweight golf bags that can be used as a carry golf bag that can be broken down to a compact size and can be expandable to a useable golf bag. Additionally, the present subject matter also relates to compact kits that include components that can be easily assembled to form a golf bag and easily disassembled for storage or shipping. For example, a collapsible golf bag can comprise a collapsible chassis having a top portion and a base with pliable sidewalls therebetween. Additionally, the collapsible golf bag can comprise a foldable stiffening rod configured to engage a portion of the top portion of the chassis and the base of the chassis to separate the top portion and the base and extend the side walls to hold at least a portion of the sidewall taut.

Additionally, the golf bag kits can comprise a carrying container having an accessible interior and a collapsible chassis having a top portion and a base with pliable sidewalls therebetween. The collapsible chassis can be compactible to a size that fits within the carrying container such that the top portion and the base are closer in proximity than when the sidewalls are fully extended. The golf bag kit can comprise a foldable stiffening rod configured to engage a portion of the top portion of the chassis and the base of the chassis to separate the top portion and the base and extend the side walls to form a golf bag. The stiffening rod can be folded to a size that fits within the carrying container. In some embodiments, a shoulder strap configured for attaching to the sidewalls of the chassis, the shoulder strap having a size that fits within the carrying container with the compact chassis and the folded stiffening rod. In some embodiments, the golf bag kit can comprise a shoulder strap configured for attaching to the sidewalls of the chassis. The shoulder strap can have a size that fits within the carrying container with the compact chassis and the folded stiffening rod.

Figure 2:
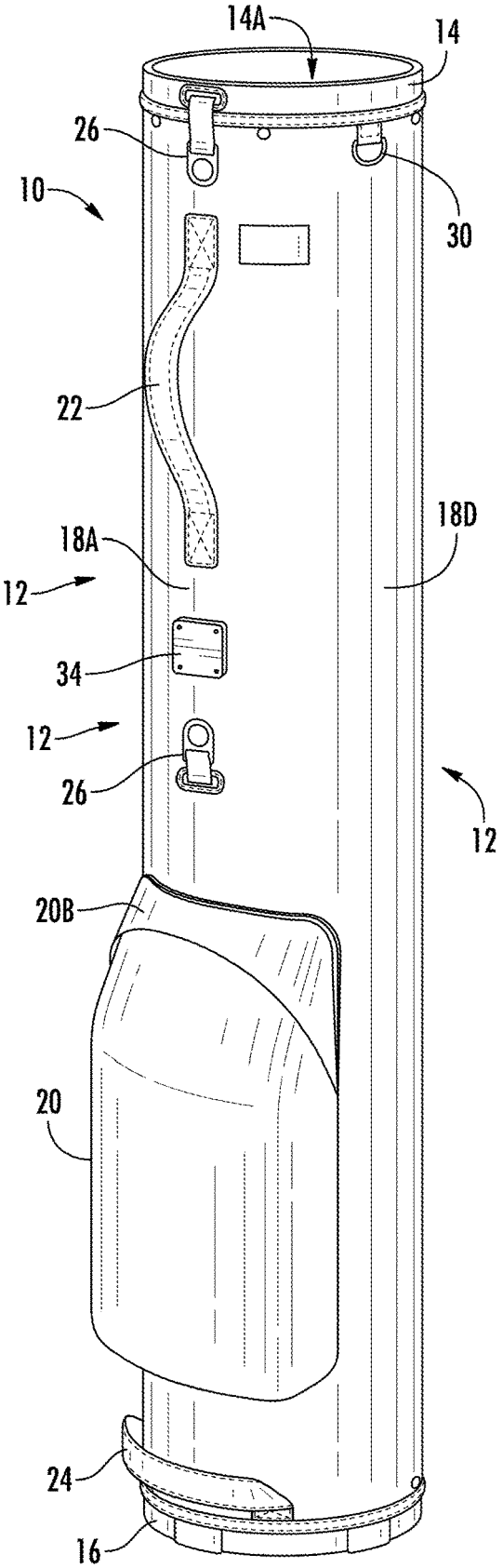
FIG. 2 illustrates a front right side perspective view of the embodiment of the golf bag according to FIG. 1.
Figure 3:
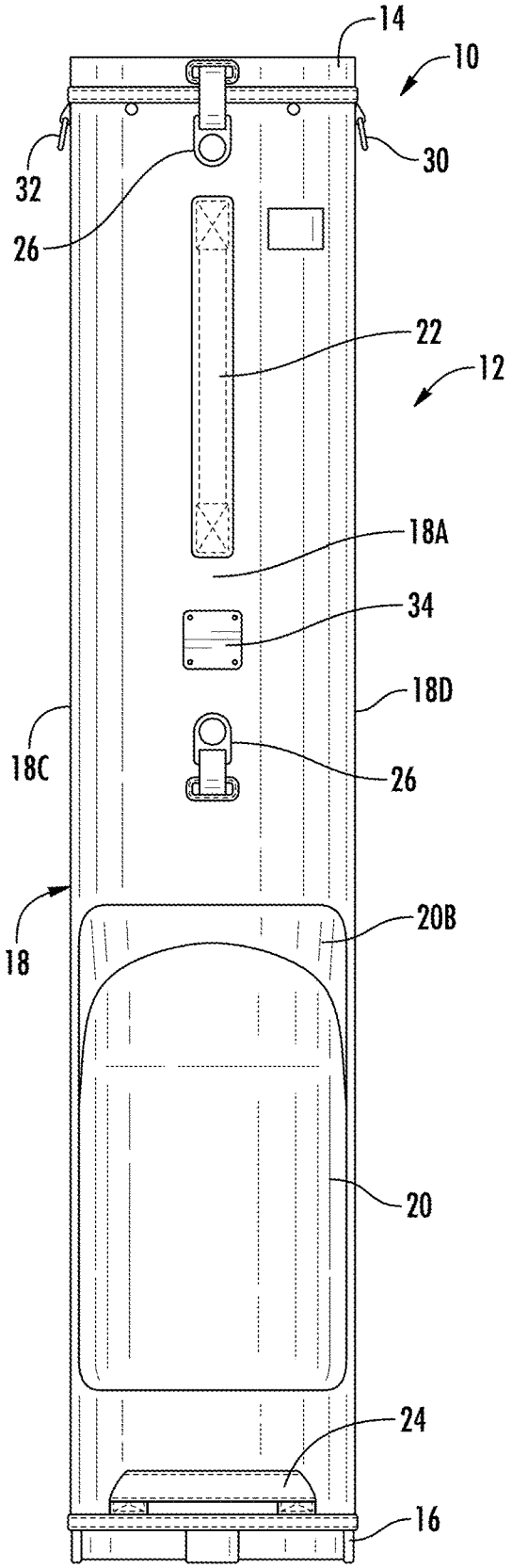
FIG. 3 illustrates a front side plan view of the embodiment of the golf bag according to FIG. 1.
Figure 4:
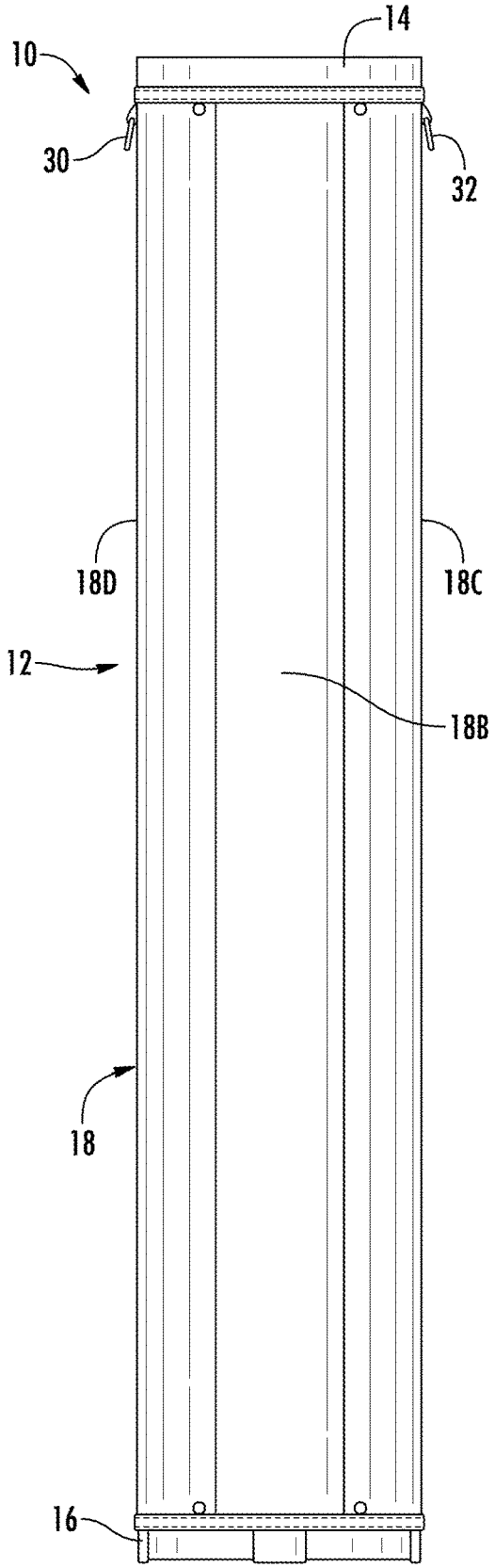
FIG. 4 illustrates a rear side plan view of the embodiment of the golf bag according to FIG. 1.
Figure 5:
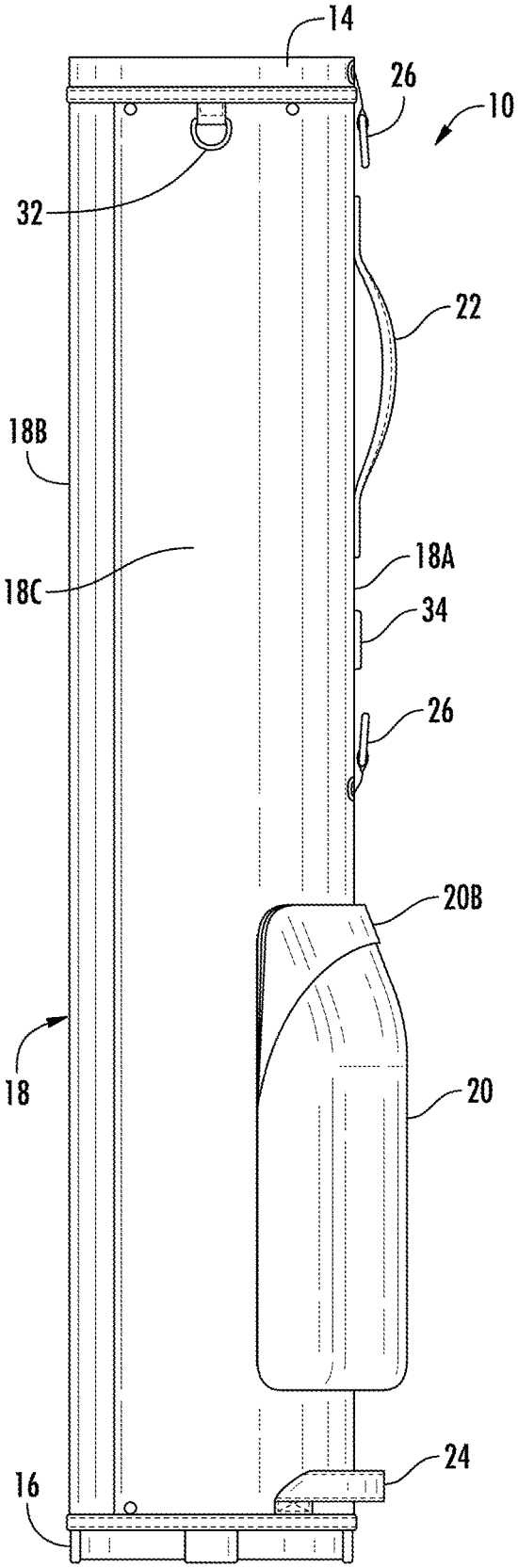
FIG. 5 illustrates a right side plan view of the embodiment of the golf bag according to FIG. 1.
Figure 6:
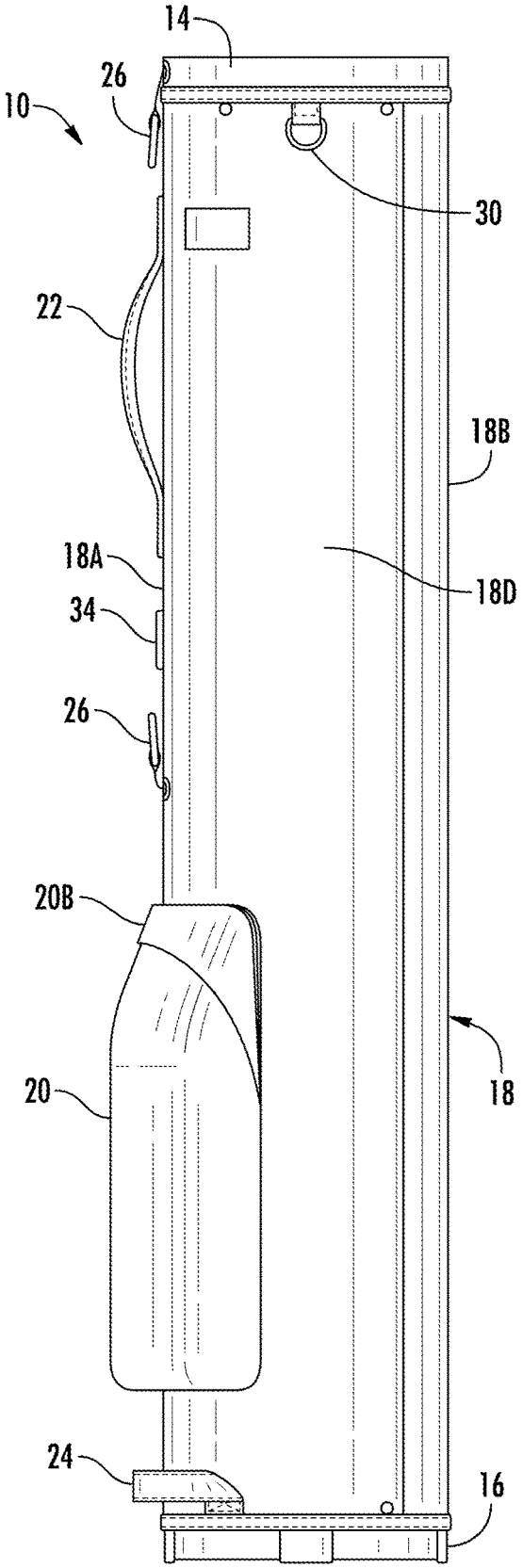
FIG. 6 illustrates a left side plan view of the embodiment of the golf bag according to FIG. 1.

Referring to FIGS. 1-9, a golf bag, generally designated 10, is provided. The golf bag 10 can comprise a collapsible chassis 12 that can be configured to receive and hold golf clubs therein. The chassis 12 can comprise a top portion 14 with one or more apertures 14A therein for receiving and holding golf clubs and a base 16 that forms a closed bottom of the golf bag 10. In the embodiment shown in FIGS. 1-12, the top portion 14 of the chassis 12 forms an annular ring that has a single aperture 14A therein. The chassis 12 can also comprise side walls 18 extending between the top portion 14 and the base 16. The side walls 18 forming a front 18A, a rear 18B, a first side 18C, and a second side 18D of the chassis 12. The side walls 18 can have one or more compartments attached thereto. For example, as shown in FIGS. 1-3, the front side 18A of the side walls 18 can include a for one or more pockets, or compartments, such as large pocket 20, for providing storage space for items a golf may find useful during a round. The pocket 20 can have an interior 20A that can be used to hold golf balls, tees, divot tools, golf gloves, brushes, ball markers, or the like. The pocket 20 can have a flap 20B that can be attachable to the pocket 20 for closing and opening the pocket 20. For example, the flap 20B can be securable to the pocket 20 by fasteners such as zippers, buttons, snaps, hook and loop fasteners, or the like.

Additionally, the chassis 12 can further comprise a handle 22 for lifting and carrying the golf bag 10 for short distances and may include a base strap 24. The handle 22 and the strap 24 can be used in combination for lifting the golf bag 10 when placing the golf bag 10 in the trunk of a car or a rear of a sports utility vehicle, for example. The handle 22 can be useful when the golfer does not want to carry the golf bag using a shoulder strap, for example, when a golfer is near a green after a chip shot and moving the golf bag 10 close to the green to putt. The handle 22 can be useful when the golfer is securing the golf bag 10 to a golf cart or a pull cart.

The chassis 12 can also include fasteners 26, such as buckles, rings, snaps, clips, or the like, for attaching a shoulder strap 28 (shown in FIG. 8) for carry the golf bag 10 over longer distances. A wide variety of different shoulder straps 28 can be used. Different straps 28 can be used that can fasten to the chassis 12 in different manners, including by clips, buckles or snaps, or a combination thereof. Additionally, in some embodiments, other fasteners (not shown) can also be provided on the chassis 12 to attach rain covers to protect the clubs within the golf bag 10 during inclement weather. Attachment rings or loops 30, 32 can be provided for attaching or holding other items such as a cleaning brush, towel, umbrella, or the like. In some embodiments, the top portion 14 of the chassis 12 can comprise a golf club divider with multiple apertures therein to separate different subsets of clubs within the golf bag. The golf bag 10 can have a personalized marker plate on it which can be on the chassis 12. For example, as shown in FIG. 1, in some embodiments, the chassis 12 can have a marker plate 34 on the side walls 18, such as front wall 18A, in a visible position. The marker plate 34 can be detachable and can be interchangeable with other marker plates to personalize the golf bag 10 based on the golfer's preferences.

Figure 9:
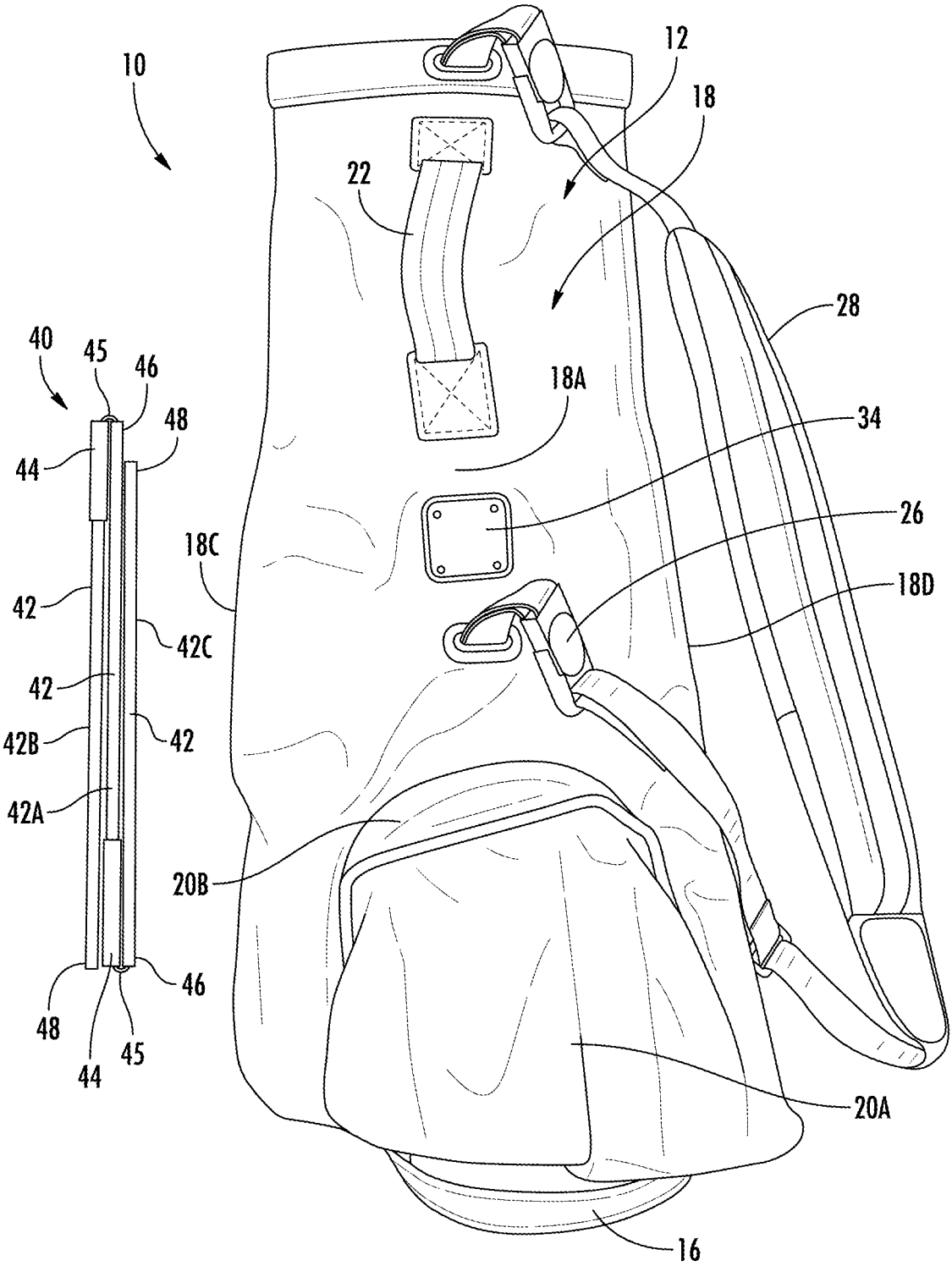
FIGS. 9 and 10 illustrate top perspective views of embodiments of components that can assembled to form a collapsible golf bag according to present subject matter.
Figure 10:
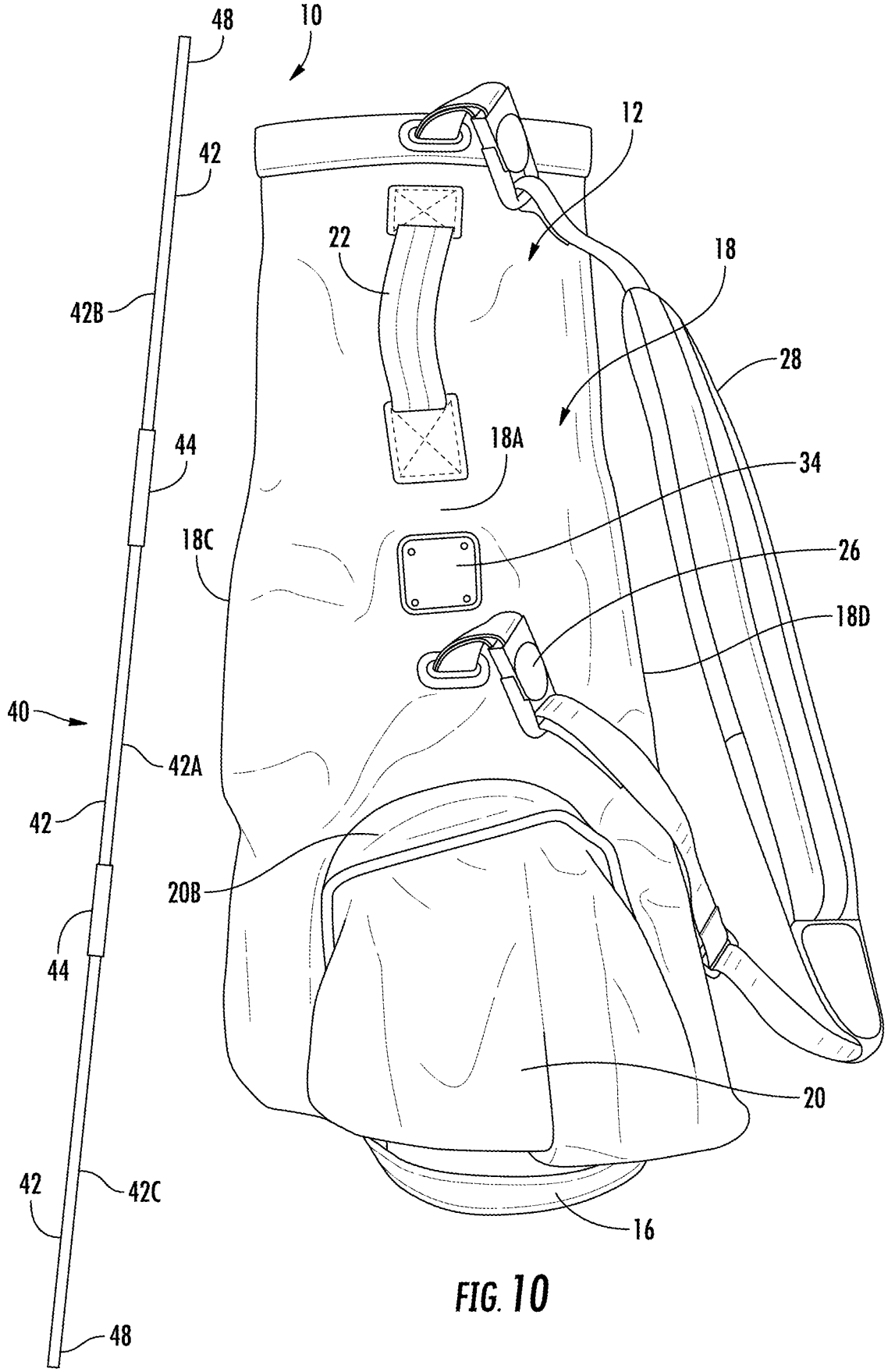
Figure 12:
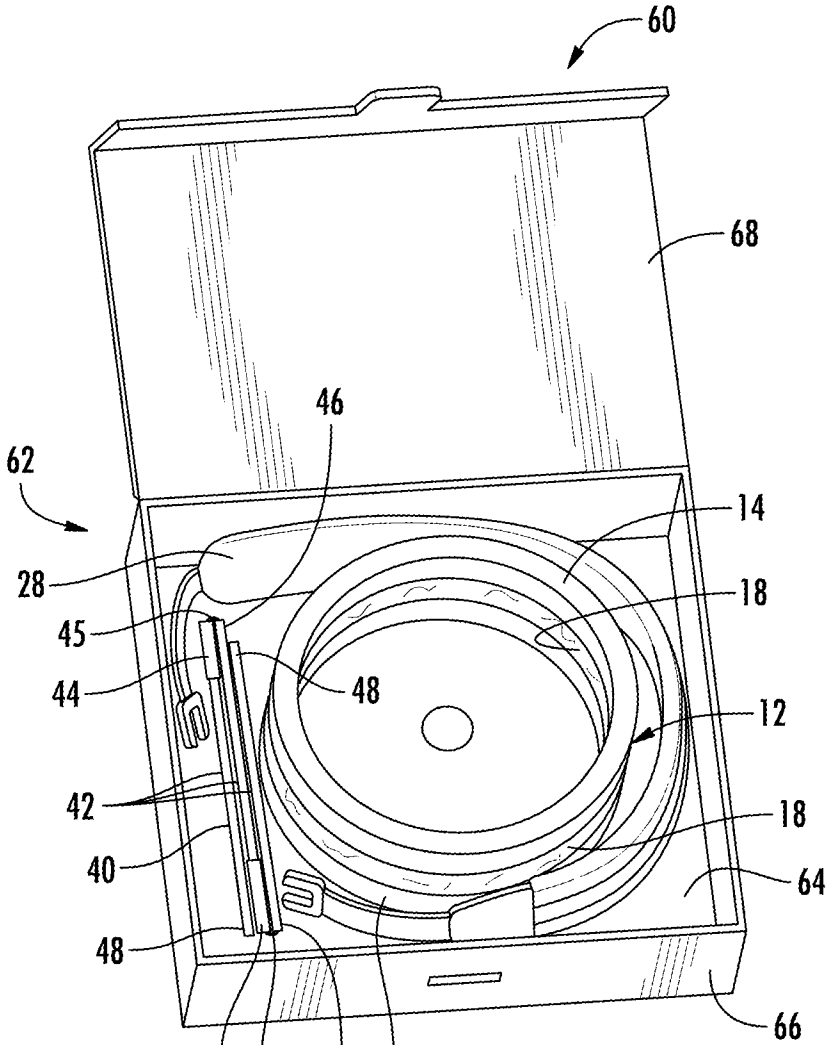

As shown in FIGS. 1-10, the side walls 18 can comprise one or more pliable materials. For example, in some embodiments, the side walls 18 of the chassis 12 of the golf bag 10 can have one or more layers in the chassis 12. The side walls 18 of the chassis 12 of the golf bag 10 can comprise an exterior substrate 36. The exterior substrate 36 can extend from the base 16 of the chassis 12 to the top portion 14 of the chassis 12 of the golf bag 10 and can form an outer surface 36A of the side walls 18. In some embodiments, the sidewalls can comprise one or more additional layers, such as an interior substrate, (not shown) that can extend along at least a portion of an inward facing surface 36B of the exterior substrate 36. The sidewalls 18 can have an interior surface 38. Depending on where another layer is present, the inward facing surface 36B of the exterior substrate 36 can comprise the interior surface 38 of the sidewalls 18. In some embodiments, one or more other layers, such as padding, can be included between the exterior substrate 36 and an interior substrate. In some embodiments, one or more layers can be strategically placed behind the exterior substrate 36. The exterior substrate 36 can comprise the front, rear, first and second sides 18A-180. The exterior substrates 36 and any additional layers that may be included can comprise a variety of materials, including leather, fabrics, such as woven, knit, or nonwoven fabrics, vinyl coated fabrics, or the like. Thus, the exterior substrate 36 can be pliable substrates that are not rigid in form as depicted in FIGS. 9, 10 and 12.

Referring to FIGS. 9-12, the golf bag 10 can comprise a segmented stiffening rod 40 that can comprise multiple detachable rod sections 42. For example, in some embodiments, the segmented stiffening rod 40 can have two or more detachable rod sections 42. In some embodiments, the segmented stiffening rod 40 can have three detachable rod sections 42 as shown in FIGS. 9-12. The detachable rod sections 42 can be inserted into one another to form the fully extended segmented stiffening rod 40. The detachable rod sections 42 can then be detached from each other to breakdown the stiffening rod 40. Once detached from one another, the detachable rod sections 42 may be separate loose pieces of the segmented stiffening rod 40 in some embodiments. In some embodiments, the detachable rod sections 42 may still be connected to one another once the segmented stiffening rod 40 is broken down.

For example, the segmented stiffening rod 40 can comprise a foldable stiffening rod 40 as shown in FIGS. 9-12. The foldable stiffening rod 40 can be configured to engage a portion of the top portion 14 of the chassis 12 and the base 16 of the chassis 12 to separate the top portion 14 and the base 16 and extend the side walls 18 to hold at least a portion of the sidewalls 18 taut. The foldable stiffening rod 40 can comprise two or more detachable rod sections 42. For example, in some embodiments, as shown in FIGS. 9 and 10, the foldable stiffening rod 40 can comprise three detachable rod sections 42. One or more rod sections 42 can include a section receiver 44 that can receive a corresponding end of an adjacent section 42 which can have a section insert 46 for insertion into the section receiver 44. For example, if the stiffening rod 40 has two rod sections, a first section 42 can have a section receiver, such as a female end for receiving and a second rod sections 42 can have a section insert 46, such as a male end for insertion into the section receiver 44. If the stiffening rod 40 has three or more sections, the middle rod sections 42A can have a section receiver 44 on one end and a section insert 46 on an opposing end, while a first end rod section 42B can have a section receiver 44 at one end and a second end rod section 42C can have a section insert 46.

For example, as shown in FIGS. 9 and 10, the foldable stiffening rod 40 can comprise three rod sections 42 including a first end rod section 42B that has a section receiver 44 at one end, a second end rod section 42C that has a section insert 46 at one end, and a middle rod section 42A can have a section receiver 44 on one end and a section insert 46 on an opposing end. For example, the section insert 46 of the middle rod section 42A can be fitted into the section receiver 44 of the first end rod section 42B and the section receiver 44 of the middle rod section 42A can accept the section insert 46 of the second end rod section 42C to extend the stiffening rod 40 to its full length as shown in FIG. 10 for insertion into the top portion 14 and base 16 of the chassis 12 of the golf bag 10. The section receivers 44 can be, for example, a female receptacle, and the section inserts 46 can be a male plug that is configured to engage the female receptacle securely to hold each rod section 42 together. In some embodiments, the section insert 46 may include a detent, or other latch, for lockingly engaging the female receiver 44. Additionally, the opposing end of the first end rod section 42B and the opposing end of the second end rod section 42C can each comprise a chassis insert 48. The chassis inserts can be inserted into a portion of the top portion 14 and the base 16 of the chassis 12 to hold at least a portion of the sidewalls 18 tight to stiffen the golf bag 10 when the extended stiffening rod 40 is inserted into the chassis 12.

In some embodiments, the foldable stiffening rod 40 can comprise a resilient shock cord 45 that extend through the two or more detachable rod sections 42 to hold the detachable rod sections 42 together when the sections 42 are detached from each other as shown in FIG. 9 and places tension on the two or more detachable rod sections 42 when the rod sections 42 are attached together as shown in FIG. 10. The shock cord 45 can comprise a core of elastic strands that are covered in a sheath to protect the elastic strands. The elastic strands can be natural or synthetic materials. The sheath can comprise natural and synthetic yarns that are knitted or braided and can also have a measurable amount of elasticity. The resilient shock cord 45 can help hold the detachable rod sections 42 together even when they are detached from one another to prevent a section 42 from being lost. The resilient shock cord 45 can be held at either end by a grommet or end tip that can serve as at least a portion of the opposing chassis inserts 48. The elasticity of the shock cord 45 can also help hold the detachable rod sections 42 are inserted into one another to form the stiffening rod 40.

Figure 11:
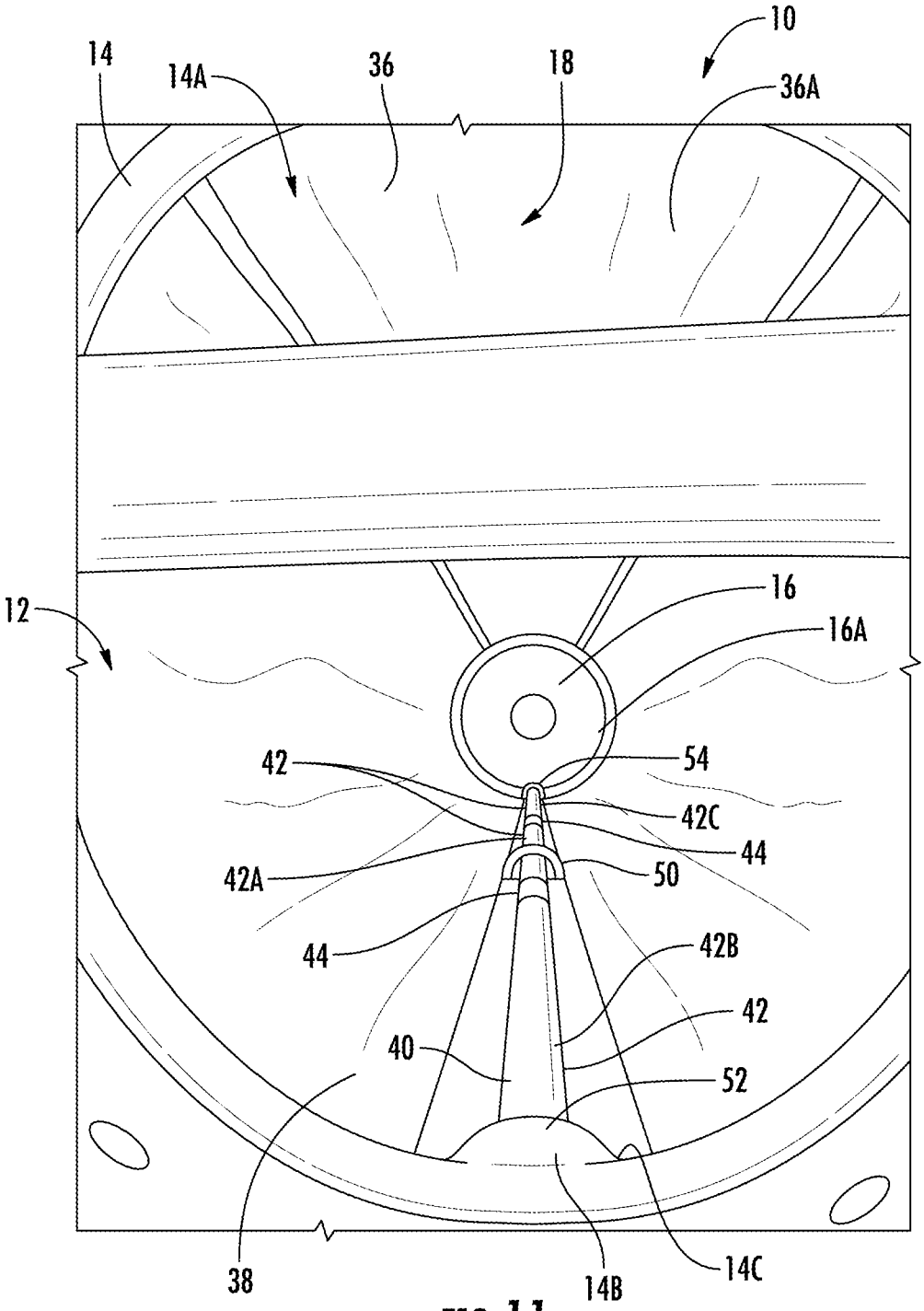
FIG. 11 illustrates a top perspective view of assembled components that form an embodiment of a collapsible golf bag according to present subject matter.

Once the detachable rod sections 42 are insert into each other and the stiffening rod 40 is fully extended, the stiffening rod 40 can be inserted into the chassis 12. As shown in FIG. 11, the chassis 12 can comprise a rod guide 50 integral to an interior surface 38 of the sidewalls 18 through which the stiffening rod 40 is insertable. The rod guide 50 can be used to maintain the stiffening rod 40 in close proximity of at least portion of the interior surface 38 of the sidewalls 18. In some embodiments, the rod guide 50 can be positioned at a position near a midpoint 12A of the chassis 12 between the top portion 14 of the chassis 12 and the base 16 of the chassis 12. In some embodiments, the chassis 12 can comprise a plurality of such rod guides 50 to aid in holding the stiffening rod 40 against the sidewalls 18.

Figure 7:
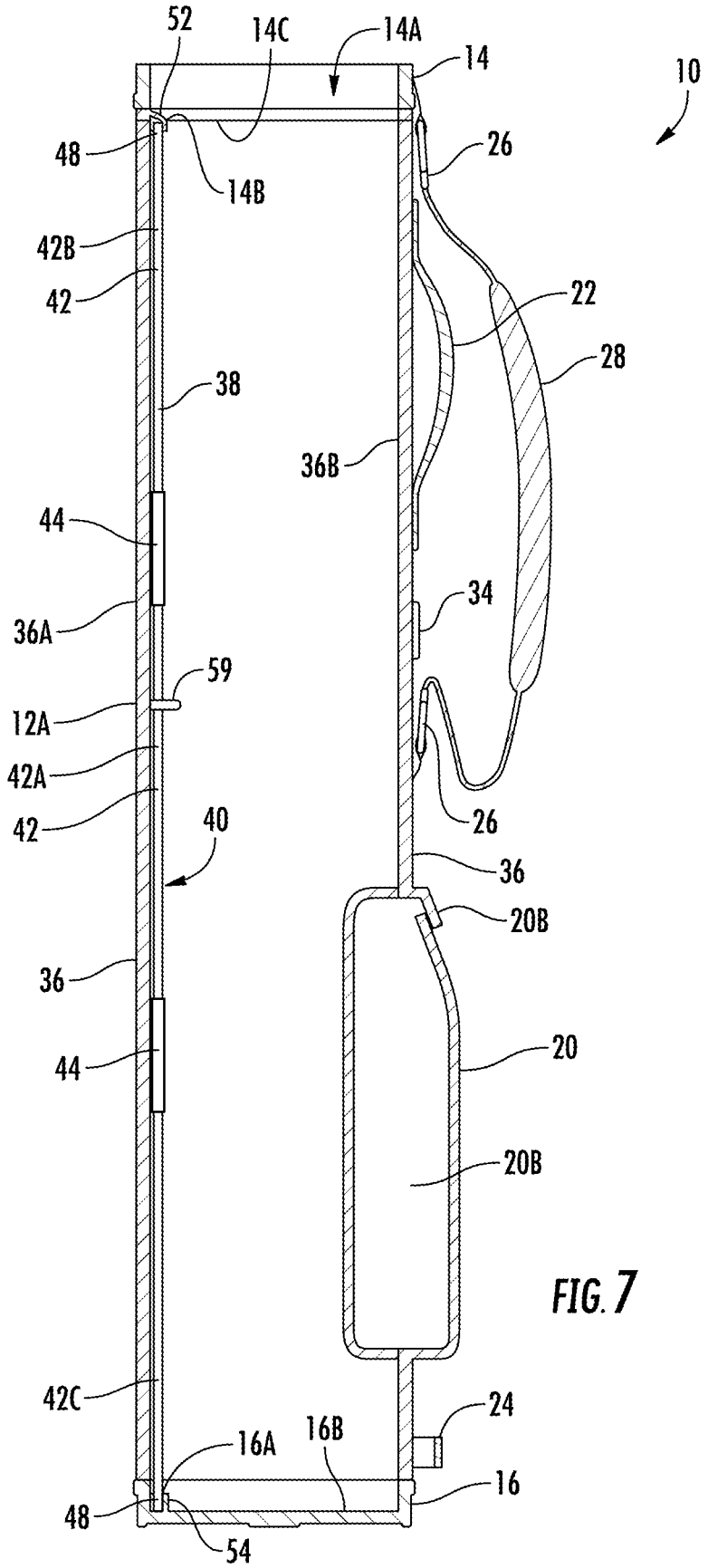
FIG. 7 illustrates a vertical cross-sectional view of an embodiment of the collapsible golf bag according to the present subject matter.
Figure 8:
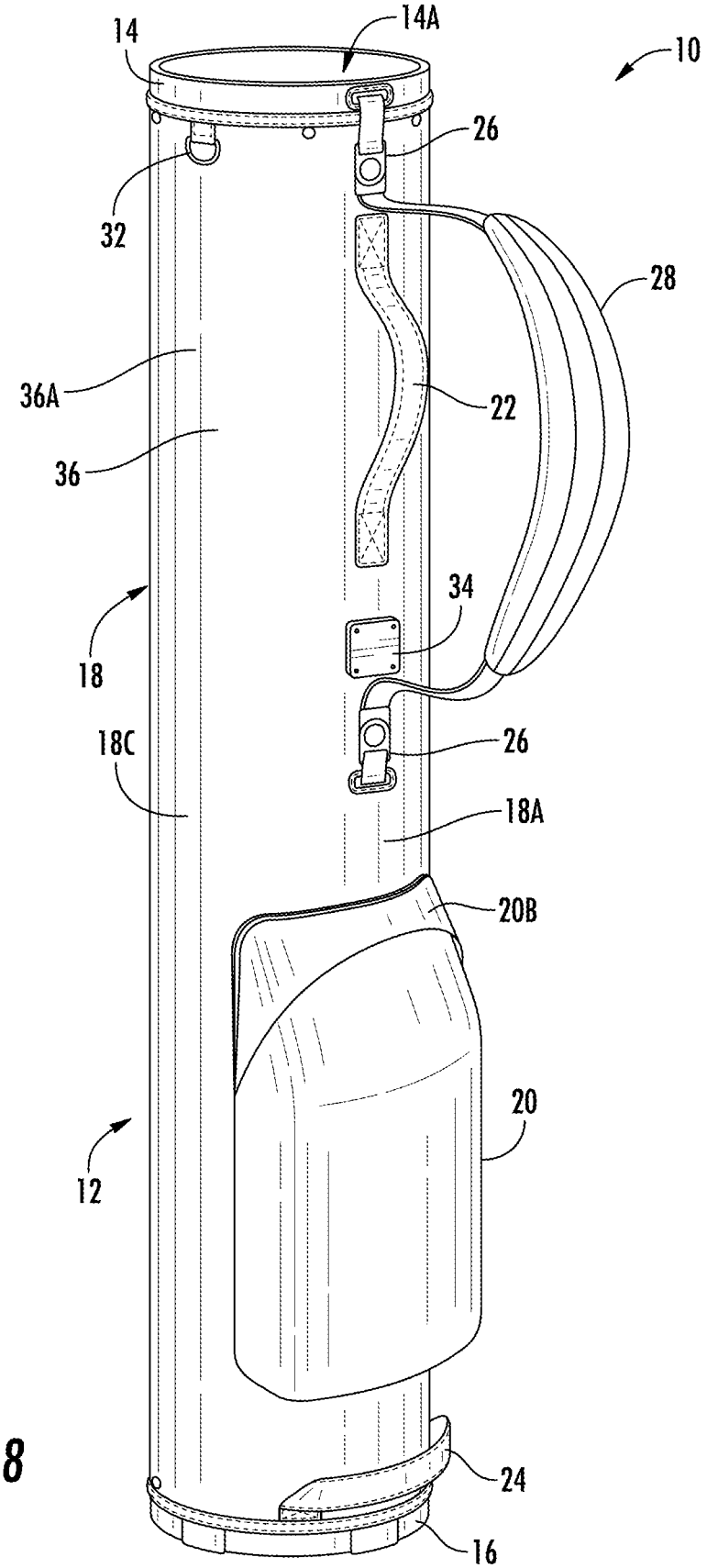
FIG. 8 illustrates a front right side perspective view of an embodiment of a collapsible golf bag with an embodiment of a shoulder strap attached according to the present subject matter.

For securing the stiffening rod 40 within the chassis 12, as shown in FIGS. 7 and 11, the top portion 14 of the chassis 12 includes a top rod receiver 52 that faces downward on an interior portion 14B of the top portion 14 of the chassis 12. For example, the top rod receiver 52 can face downward on an interior portion 14B of a bottom 14 of the top portion 14 of the chassis 12. Similarly, the base 16 of the chassis 12 includes a bottom rod receiver 54 that faces upward on an interior portion 16A of the base 16. For example, the bottom rod receiver 54 can face upward on an interior portion 16A of a top 16B of the base 16. The top rod receiver 52 and the bottom rod receiver 54 can comprise female receptacles that can be configured to receive and hold the chassis inserts 48 of the stiffening rod 40 in place within the cassis 12. In some embodiments, the top and bottom rod receivers 52, 54 can hold the stiffening rod 40 in place within the chassis 12 via a press fit. In some embodiments, the chassis inserts 48 of the stiffening rod 40 may include a detent, or other latch, for lockingly engaging the top rod receiver 52 and the bottom rod receiver 54 to securely hold the stiffening rod 40 in place.

Once the stiffening rod 40 is fully extended and inserted into the chassis 12, the golf bag 10 is formed and golf clubs can be inserted into the aperture 14A in the top portion of the chassis 12. A single stiffening rod 40 can be used to provide enough structure within the chassis 12 so that the chassis 12 is held in a shape of a golf bag 10. For example, the stiffening rod 40 can have a length such that when the chassis inserts 48 engage the top rod receiver 52 of the top portion 14 of the chassis 12 and the bottom rod receiver 54 of the base 16 of the chassis 12 to separate the top portion 14 and the base 16 and extend the side walls 18 to hold at least a portion of the sidewalls 18 taut. In some embodiments, the top portion 14 and the base 16 of the chassis 12 can be rigid such that the top portion 14 and the base 16 of the chassis 12 are cantilevered from the inserted stiffening rod 40. This rigidity of the top portion 14 and the base 16 of the chassis 12 can aid in holding the top portion 14 and the base 16 apart from one another keeping the sidewalls 18 extended around the golf bag 10. Additionally, the placement of the top and bottom shoulder strap fasteners 26 on the chassis 12 can be used to add rigidity to the chassis 12 of the golf bag 10 when it is being carried by a golfer. When the shoulder strap 28 is secured to the top strap fastener 26 at the top portion 14 of the chassis 12, and to the bottom strap fastener 26 at a mid-portion of the sidewalls of the chassis 12, the top portion 14 can be placed under tension at the point across from the stiffening rod 40 where the strap fastener 26 attaches when the strap 28 is placed on a shoulder of a golfer. This tension can aid in holding the sidewalls 18 between the top portion 14 of the chassis 12 and the bottom strap fastener 26 taut as well. The sidewalls 18 being held in such a position can also help to hold the aperture 14A in the top portion 14 about parallel with the base 16 of the chassis 12, which can make removal of golf clubs easier.

Figure 13:
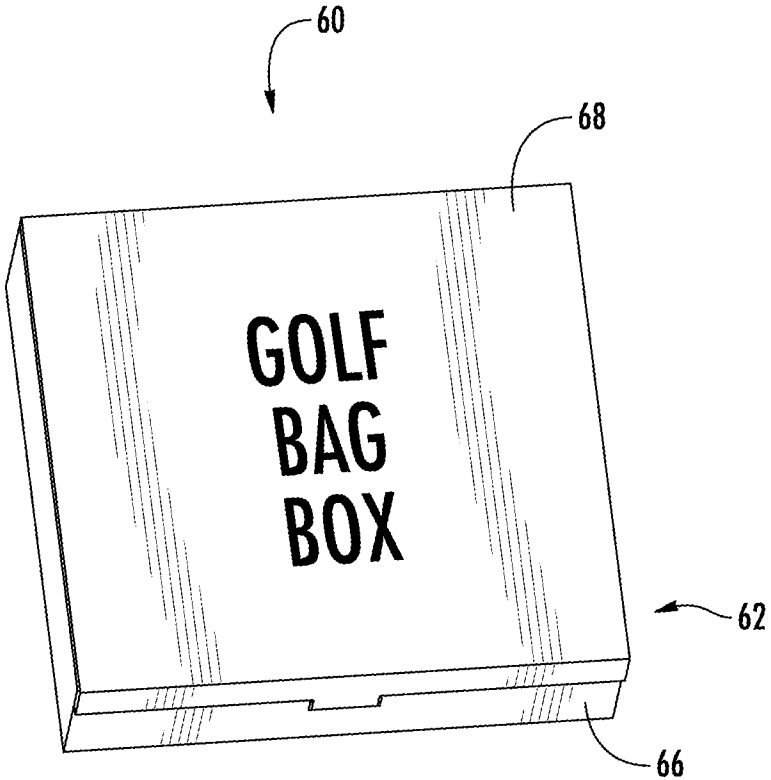
FIGS. 12 and 13 illustrates top perspective views of an embodiment of a kit that can include a box that can house components of an embodiment of a collapsible golf bag.

Referring to FIGS. 12 and 13, a golf bag kit, generally designated 60, can be provided that includes components of a golf bag 10. For example, the golf bag kit 60 can comprise a carrying container 62. In some embodiments, the carrying container 62 can comprise a bottom 64 and walls 66 can form an accessible interior. Additionally, the carrying container can comprise a lid 68 that can be opened and closed to permit access to the accessible interior. The lid 68 can be secured in a closed position as shown in FIG. 13 for easy and compact shipping when the components of the golf bag 10 are included in the carrying container 62. For example, the carrying container 60 can be a box.

The golf bag kit 60 can comprise a collapsible chassis 12, as described above, having a top portion 14 and a base 16 with pliable sidewalls 18 therebetween. The collapsible chassis 12 can be compactible to a size that fits within the accessible interior of the carrying container 62 such that top portion 14 and the base 16 are within closer proximity than when the sidewalls 18 are fully extended. As shown in FIG. 12, the sidewalls 18 are compacted, or folded in a manner that the top portion 14 of the chassis 12 is within close proximity of the base 16 of the chassis 12. This allows for the carrying container 62 to be much smaller in volume that if the sidewalls 18 were fully extended such that the chassis 12 takes the shape of a golf bag 10.

The golf bag kit 60 can also comprise a segmented stiffening rod 40, as described above. For example, in some embodiments, the segmented stiffening rod 40 can comprise a foldable stiffening rod 40 as shown in FIG. 12. As shown in FIG. 12, the foldable stiffening rod 40 can comprises two more rod sections 42 that can be secured together to form a fully extended stiffening rod 40. The fully extended stiffening rod 40 can be configured to engage a portion of the top portion 14 of the chassis 12 and the base 16 of the chassis 12 to separate the top portion 14 and the base 12 and extend the side walls 18 to form a golf bag. In the folded position, the stiffening rod 40 is folded to a size that fits within the accessible interior of the carrying container 62. As described above, the stiffening rod 40 can comprise a resilient shock cord 45 that extend through the detachable rod sections 42 to hold the detachable rod sections 42 together when the sections 42 are detached from each other. The shock cord 45 can place tension on the detachable rod section when the rod sections 42 when the sections 42 are attached together to form the fully extended stiffening rod 40.

As shown in FIG. 12, the golf bag kit 60 can further comprise a shoulder strap 28 that can be configured for attaching to the chassis 12. For example, in some embodiments, the shoulder strap 28 can be securable to the sidewalls 18. In some embodiments as shown in FIGS. 7-10, the shoulder strap 28 can be securable to both the top portion 14 and the sidewalls 18 of the chassis 12. The shoulder strap 28 can be adjustable to best fit the shoulders of the golfer that is using it. The shoulder strap 28 can have a size that fits within the accessible interior of the carrying container 62 with the compact chassis 12 and the folded stiffening rod 40.

As with the golf bag 10 described above with reference to FIGS. 1-11, the golf bag 10 provided in the carrying container 62 of the golf bag kit 60 can have many of the same features. For example, the sidewalls 18 of the chassis 12 can comprise one or more rod guides 50 integral to the interior surface 38 of the sidewalls 18 through which the stiffening rod 40 is insertable as shown in FIGS. 7 and 11. Such a rod guide 50 can be positioned at a position near a midpoint of the chassis 12 between the top portion 14 of the chassis 12 and the base 16 of the chassis 16. To facilitate attachment of the stiffening rod 40, the top portion 14 can include a top rod receiver 52 that faces downward on an interior portion the top portion 14 and the base 16 can include a bottom rod receiver 54 that faces upward on an interior portion the base 16 of the chassis 12 as shown in FIGS. 7 and 11. In some embodiments, the top and bottom rod receivers 52, 54 can hold the stiffening rod 40 in place within the chassis 12 via a press fit. As shown in FIG. 7, the top portion 14 and the base 16 of the chassis 12 can be rigid such that the top portion 14 and the base 16 are cantilevered from the inserted stiffening rod 40 to make the aperture 14A in which golf clubs are insertable easily accessible.

Thus, as explained above, collapsible golf bags and golf bag kits are provided herein. A collapsible golf bag, as disclosed herein, can comprise a collapsible chassis having a top portion and a base with pliable sidewalls therebetween. Additionally, the collapsible golf bag can comprise a foldable stiffening rod configured to engage a portion of the top portion of the chassis and the base of the chassis to separate the top portion and the base and extend the side walls to hold at least a portion of the sidewall taut.

Additionally, the golf bag kits can comprise a carrying container having an accessible interior and a collapsible chassis having a top portion and a base with pliable sidewalls therebetween. The collapsible chassis can be compactible to a size that fits within the carrying container such that the top portion and the base are closer in proximity than when the sidewalls are fully extended. The golf bag kit can comprise a foldable stiffening rod configured to engage a portion of the top portion of the chassis and the base of the chassis to separate the top portion and the base and extend the side walls to form a golf bag. The stiffening rod can be folded to a size that fits within the carrying container. In some embodiments, a shoulder strap configured for attaching to the chassis, the shoulder strap having a size that fits within the carrying container with the compact chassis and the folded stiffening rod. In some embodiments, the golf bag kit can comprise a shoulder strap configured for attaching to the chassis. The shoulder strap can have a size that fits within the carrying container with the compact chassis and the folded stiffening rod.

Further, methods of forming golf bag are also provided. Some embodiments of such method can include providing a collapsed chassis having a top portion and a base with pliable sidewalls therebetween and a folded stiffening rod. The method can comprise unfolding the stiffening rod to its full length and inserting the stiffening rod into a rod receiver of the top portion of the chassis and a rod receiver of the base of the chassis to separate the top portion and the base and extend the side walls to form a golf bag. In some embodiments, the method can include attaching a shoulder strap to the sidewalls of the chassis.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A golf bag comprising:

a collapsible chassis configured to receive golf clubs therein, the chassis having a rigid top portion and a rigid base with sidewalls therebetween; and a foldable stiffening rod comprising three detachable rod sections, the foldable stiffening rod configured to engage a portion of the top portion of the chassis and the base of the chassis when the stiffening rod is fully extended with the detachable rod sections secured together to separate the top portion and the base and extend the sidewalls to hold at least a portion of the sidewalls taut such that the top portion and the base are cantilevered from the inserted stiffening rod, the foldable stiffening rod comprising a resilient shock cord that extend through the three detachable rod sections to hold the detachable rod sections together when the sections are detached from each other and to place tension on the three detachable rod sections when the rod sections are attached together; and a rod guide integral to an interior surface of the sidewalls near a midpoint of the chassis through which the extended stiffening rod is insertable.

2. The golf bag according to claim 1, wherein the top portion of the chassis includes a top rod receiver that faces downward on an interior portion of the top portion.

3. The golf bag according to claim 2, wherein the base includes a bottom rod receiver that faces upward on an interior portion of the base.

4. The golf bag according to claim 3, wherein the top and bottom rod receivers hold the extended stiffening rod in place within the chassis via a press fit.

5. The golf bag according to claim 1, wherein the three detachable rod sections comprising a first end rod section, a second end rod section, and a middle rod section, the first end rod section having a section receiver at one end for a receiving a section insert of the middle rod section, and the middle rod section having a section receiver at an end oppose the section insert for a receiving a section insert of the second end rod section.

6. A golf bag kit comprising:

a carrying container having an accessible interior;

a collapsible chassis having a rigid top portion and a rigid base with sidewalls therebetween, the collapsible chassis being compactible to a size that fits with the accessible interior of the carrying container such that top portion and the base of the chassis are closer in proximity to each other than when the sidewalls are fully extended; and a foldable stiffening rod comprising a first end rod section, a second end rod section, and a middle rod section and configured to engage a portion of the top portion of the chassis and the base of the chassis to separate the top portion and the base and extend the sidewalls to form a golf bag when the stiffening rod is fully extended such that the top portion and the base are cantilevered from the inserted stiffening rod, the foldable stiffening rod comprising a resilient shock cord that extend through the first end, the second end, and middle rod sections to hold the detachable rod sections together when the sections are detached from each other and to place tension on the rod sections when the rod sections are attached together and the foldable stiffening rod being folded to a size that fits within the accessible interior of the carrying container; and wherein the sidewalls of the collapsible chassis further comprise a rod guide integral to an interior surface of the sidewalls near a midpoint of the collapsible chassis between the top portion and the base of the collapsible chassis through which the foldable stiffening rod is insertable.

7. The golf bag kit according to claim 6, further comprising a shoulder strap configured for attaching to the chassis, the shoulder strap having a size that fits within the accessible interior of the carrying container with the compact chassis and the folded stiffening rod.

8. The golf bag kit according to claim 6, wherein the top portion includes a top rod receiver that faces downward on an interior portion of the top portion.

9. The golf bag kit according to claim 8, wherein the base includes a bottom rod receiver that faces upward on an interior portion of the base.

10. The golf bag kit according to claim 9, wherein the top and bottom rod receivers hold the stiffening rod in place within the chassis via a press fit when the stiffening rod is fully extended and inserted into the top and bottom rod receivers.

11. A method of forming a golf bag, the method comprising:

providing a collapsed chassis having a rigid top portion and a rigid base with pliable sidewalls therebetween, the sidewalls comprising a rod guide integral to an interior surface of the sidewalls near a midpoint of the collapsible chassis between the top portion and the base of the chassis and a folded stiffening rod comprising a first end rod section, a second end rod section, and a middle rod section, and a resilient shock cord that extend through the first end, the second end, and middle rod sections to hold the detachable rod sections together when the rod sections are detached from each other and to place tension on the rod sections when the rod sections are attached together;

extending the stiffening rod to its full length; and inserting the stiffening rod through the rod guide and into a rod receiver of the top portion of the chassis and a rod receiver of the base of the chassis to separate the top portion and the base and extend the side walls to form a golf bag such that the top portion and the base are cantilevered from the inserted stiffening rod.

12. The method according to claim 11, further comprising attaching a shoulder strap to the sidewalls of the chassis.

* * * * *